US007087847B2

(12) United States Patent
Parkinson et al.

(10) Patent No.: US 7,087,847 B2
(45) Date of Patent: Aug. 8, 2006

(54) ELASTOMER KEYPAD AND BEZEL

(75) Inventors: Joel Keith Parkinson, Chandler, AZ (US); Wayne Keith Parkinson, Phoenix, AZ (US)

(73) Assignee: White Electronic Designs Corporation, Phoenix, AZ (US)

( * ) Notice: Subject to any disclaimer, the term of this patent is extended or adjusted under 35 U.S.C. 154(b) by 24 days.

(21) Appl. No.: 10/719,974

(22) Filed: Nov. 20, 2003

(65) Prior Publication Data

US 2005/0109602 A1 May 26, 2005

(51) Int. Cl.
*H01H 13/705* (2006.01)

(52) U.S. Cl. ..... 200/5 A; 200/6 A; 200/302.2; 200/345; 200/512

(58) Field of Classification Search ..... 200/1 R–1 TK, 200/5 A, 6 A, 341–345, 314, 293–298, 512–517, 200/302.1, 302.2, 302.3, 61.62–61.84
See application file for complete search history.

(56) References Cited

U.S. PATENT DOCUMENTS 4,366,463 A * 12/1982 Barker ..... 338/69
4,536,625 A * 8/1985 Bebie ..... 200/5 A
4,647,729 A * 3/1987 Collar et al. ..... 200/5 A
5,219,067 A * 6/1993 Lima et al. ..... 200/302.2
5,367,133 A * 11/1994 Schmidt et al. ..... 200/5 A
5,746,307 A * 5/1998 Joss et al. ..... 200/303
5,973,621 A * 10/1999 Levy ..... 341/22
6,180,895 B1 * 1/2001 Hutchinson et al. ..... 200/5 A
6,500,169 B1 12/2002 Deng
6,614,905 B1 * 9/2003 Kristensen ..... 379/368
6,653,581 B1 * 11/2003 Bassi ..... 200/61.62

* cited by examiner

*Primary Examiner*—Michael A. Friedhofer
(74) *Attorney, Agent, or Firm*—David E. Rogers; Allen J. Moss; Squire, Sanders & Dempsey L.L.P.

(57) ABSTRACT

A switch comprising one or more keys mounted on a mat is disclosed. Each of the one or more keys includes a top section, a bottom section and an undercut region formed between the top section, the bottom section and the mat. Each of the one or more keys having a conductive surface mounted on an underside of the one or more keys. The switch also includes a substrate having one or more switch circuits corresponding to each of the one or more keys. Each of the one or more keys is mounted over each of the switch circuits and wherein when each of the keys is depressed the conductive surface contacts the switch circuit and completes the circuit. The switch further includes a bezel having one or more openings corresponding to the one or more keys. Each of the one or more keys is mounted through the one or more openings such that the top section of each of the one or more keys is on a top surface of the bezel and the bezel is in the undercut region.

38 Claims, 5 Drawing Sheets

ELASTOMER KEYPAD AND BEZEL

TECHNICAL FIELD OF THE INVENTION

This invention relates to the field of keypad controls and more specifically, but not exclusively, to an elastomer keypad and integrated bezel.

BACKGROUND OF THE INVENTION

In recent years mechanical switches have been replaced by elastomer keypads in applications where longevity of the keys in the keypad as well as aesthetic considerations are important. One application for elastomer keypads is providing control keys for appliances. Elastomer keypads are typically made from a pliable material such as silicon rubber and are mounted over a circuit on a substrate, such as a printed circuit board. The circuit may be defined by two conductive lines or a conductive surface separated by a small distance. Each elastomer key in the elastomer keypad is a raised portion that can be manually depressed. After the elastomer key is released, it will return to its original non-depressed state. The underside (in relation to the raised portion where the elastomer key is depressed) of the elastomer key typically includes a conductive element. This conductive element is made of a conductive material such as carbon. The elastomer keypad is placed over the substrate such that the conductive element in each elastomer key is aligned over the conductive lines. When the elastomer key is depressed, it will deform by flexing inward, resulting in the conductive element contacting both of the conductive lines thereby completing the circuit connection between the conductive lines.

Typically a bezel having openings for each elastomer key to pass through is mounted over the elastomer keypad. This keeps the elastomer keys in the correct position over the substrate. The openings of the bezel are designed to be larger than all parts of the elastomer keys to avoid having the elastomer keys stick or bind to the opening of the bezel. However, because of this loose fit, dirt or moisture can penetrate between the elastomer key and the bezel opening. This can lead to poor performance and/or deterioration of the elastomer key.

Additionally, since the elastomer keys in an elastomer keypad return to their original shape after being depressed, it is often times difficult to determine the status of the machine or appliance it is mounted on after an elastomer key is depressed.

SUMMARY OF THE INVENTION

Thus, there is a need for an improved elastomer key for use with a bezel. In one embodiment, a switch comprising one or more keys mounted on a mat is disclosed. Each of the one or more keys includes a top section, a bottom section and an undercut region formed between the top section, the bottom section and the mat. Each of the one more keys having a conductive surface mounted on an underside of the one or more keys.

The switch also includes a substrate having one or more switch circuits corresponding to each of the one or more keys. Each of the one or more keys is mounted over each of the switch circuits and wherein when each of the keys is depressed the conductive surface contacts the switch circuit and completes the circuit.

The switch further includes a bezel having one or more openings corresponding to the one or more keys. Each of the one or more keys is mounted through the one or more openings such that the top section of each of the one or more keys is on a top surface of the bezel and the bezel resides in the undercut region of the one or more keys.

Further aspects of the invention include the use of illumination sources under the keys. The illumination sources will illuminate the key when the key is selected to a certain state, such as on or off. A light emitting diode can provide the illumination.

Further aspects of the invention include providing a circuit board with an opening cut out in the circuit board. A display is mounted on the backside of the circuit board and positioned such that the display is visible through the opening. This allows the keyboard and bezel to be mounted in a way that minimizes key travel and allows for a flush installation of the key, bezel and substrate including the display.

BRIEF DESCRIPTION OF THE DRAWINGS

These and other aspects, features and advantages of the present invention will become apparent from the following description of the invention in reference to the appended drawing in which like numerals denote like elements and in which.

DETAILED DESCRIPTION OF DRAWINGS

An elastomer keypad and bezel in accordance with one or more embodiments of the present invention provides elastomer keys for use in such applications as control switches that are sealed against dust and moisture penetration. Additionally, embodiments of the present invention provide an elastomer keypad which include individual elastomer keys that can provide a visual indication of the state of the switch, such as on or off.

Figure 1:
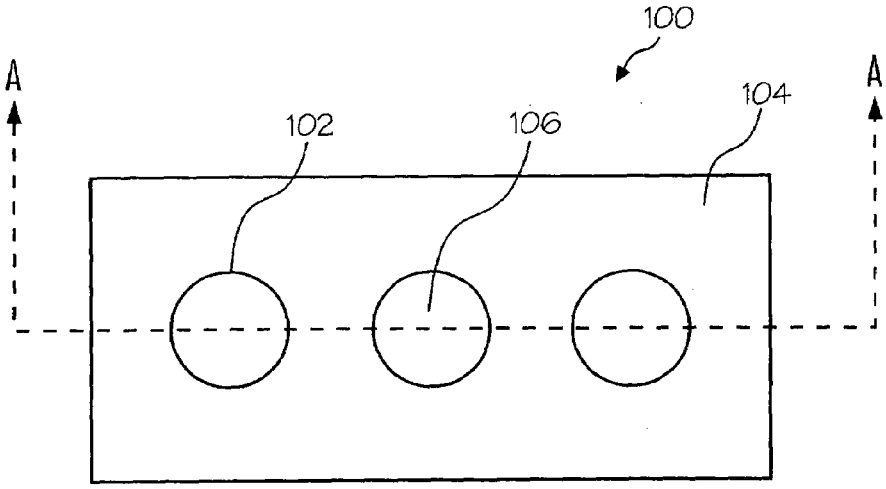
FIG. 1 is an overhead view of an elastomer keypad.

For example, FIGS. 1–6 illustrate an elastomer keypad 100 according to various aspects of the invention. As best seen in FIG. 1, elastomer keypad 100 comprises one or more elastomer keys 102 and an integrated mat 104. Indicia 106, such as alphanumeric characters or graphics, can be provided on each elastomer key 102 to denote the function of the elastomer key 102.

Elastomer keys 102 of the present invention are designed to deform under pressure and then to return to its non-deformed shape when pressure is removed. Therefore, the elastomer keypad 100 is preferably made from a flexible material such as silicon rubber, although other materials that can deform and then return to shape can be used. For example, other elastomers such as polyisoprene or natural rubber, polybutadiene, polyisobutylene and polyurethanes could be used. Additionally, mechanical devices such as springs or resilient contacts under each key could be used to return key to a non-deformed state.

Figure 2A:
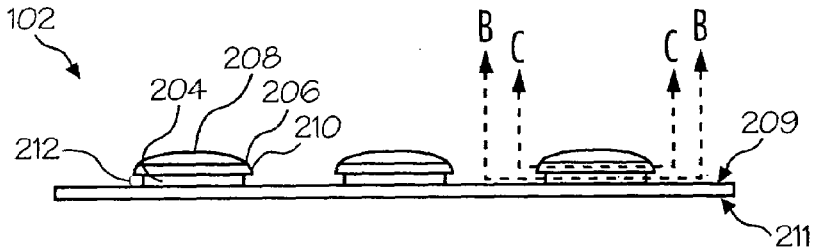
FIG. 2*a* is a side view of FIG. 1, including cross sections of a key taken thru lines B—B and C—C.
Figure 2B:
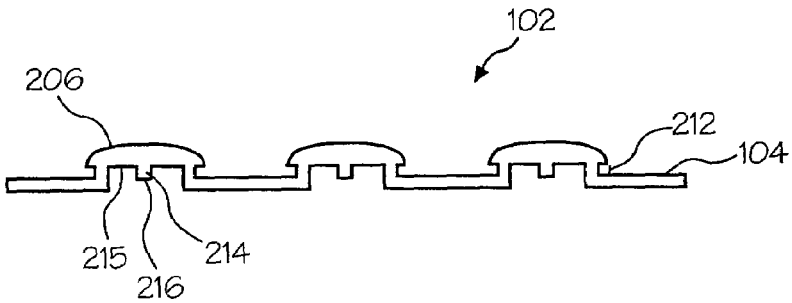
FIG. 2*b* is a cutaway side view of FIG. 1 taken along the line A—A.

Each of the elastomer keys 102 of the present invention includes a base portion 204 and a top portion 206 attached to the base portion 204, as seen in FIGS. 2*a* and 2*b*. The top portion 206 is the portion of the elastomer key 102 that is touched by a user to depress the elastomer key 102. The base portion 204 attaches a mat 104 to top portion 206. The mat 104 is typically formed at the same time and of the same material as the elastomer key 102 and includes a top mat surface 209 and a bottom mat surface 211. Alternatively, elastomer keypad 100 may include the elastomer keys 102 and without mat 104. Top portion 206 includes a top surface 208, where indicia 106 such as for labeling the function of the elastomer key 102 can be applied. Top portion 206 also includes a sidewall 210.

Figure 3:
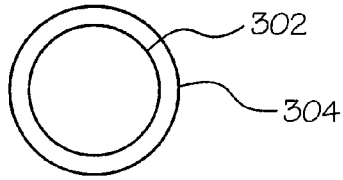
FIG. 3 is a cross sectional view of a key of an elastomer keypad.

Base portion 204 is smaller than the top portion 206. One way to define smaller in this context is that smaller means that the largest cross sectional area of the base portion 204 is smaller than the largest cross sectional area of the top portion 206. As best seen in FIG. 3, a first cross sectional area 302 is the cross-sectional area of the base portion 204 taken along the line B—B (FIG. 2*a*). Second cross sectional area 304 is the cross sectional area of the top portion 206 taken along the line C—C, (FIG. 2*a*). The first cross sectional area 302 is smaller that the second cross sectional area 304. As seen in FIG. 2*b*, the combination of the larger top portion 206, the smaller base portion 204 and the mat 104 forms an undercut region 212. While the top portion 206 and the base portion 204 are shown as generally circular in cross section, any shape can be used for elastomer key 102. Indeed, the base portion 204 and the top portion 206 can each be a different shape.

Another way to define smaller in this context is that smaller means that the perimeter of the largest cross section of the base portion 204 is smaller than the perimeter of the largest cross section of the top portion 206. The perimeter of a figure is the distance around the edge of a figure and, for the purpose of this patent, includes the distance around a curved figure, such as a circle.

Elastomer key 102 also, in one embodiment, includes a stem 214 extending down from the inside 215 of top portion 206. A conductive surface 216 can be attached to the stem 214 if desired. When elastomer key 102 is depressed, top portion 206 flexes inward driving the conductive surface 216 downward. The conductive surface 216 will then complete a switching circuit, as will be discussed in detail below. Conductive surface 216 can be any conductive material. In one embodiment, conductive surface 216 is made of carbon.

In an alternate embodiment, stem or protrusion 214 may not include a conducting surface 216, but rather may merely abut against a separate contact structure (e.g., a bubble contact) such that, when elastomer key 102 is depressed, stem 214 causes the separate contact structure to complete the circuit. Alternatively, stem 214 may be omitted entirely.

Elastomer keys 102 are typically sized so that they can be easily selected with a finger. In one embodiment, the largest part of the top portion 206 is 0.64 inches across and 0.110 inches high. The conductive surface 216 is 0.026 inches above the bottom mat surface 211 of mat 104. This means when the elastomer key 102 is depressed the conductive surface only has to move 0.026 inches to reach the bottom mat surface 211 of mat 104 under which a switching circuit can be provided. This is known as the travel of the elastomer key 102.

As discussed previously, elastomer keypad 100 is, in one embodiment, made from silicon rubber. One way of manufacturing the elastomer keypad 100 is by compression molding. Compression molding utilizes a two piece mold, one half for the front of the elastomer keypad 100 and one for the back of elastomer keypad 100. Silicon rubber (or other elastomer materials) is placed in the mold. The mold is closed and pressure is applied using a press. The mold is also heated as pressure is applied. This causes the silicon rubber to melt and flow into the cavities of the mold. The pressure and heat process continues for a certain length of time, typically around an hour. The mold is then opened and the elastomer keypad 100 is removed. The conductive surface 216 can either be placed in the mold, in which case the conductive surface 216 is vulcanized to the elastomer keypad 100, or it can be printed on to the elastomer keypad using a screen printing process. The indicia 106 on the elastomer keys 102 can be printed on, or the elastomer keys can be painted (e.g., black) and the indicia 106 etched on, using, for example, a laser. This description of the manufacturing process of elastomer keypad 100 is only one example of a manufacturing process; any other suitable manufacturing process can be used depending on the materials selected and the desired aesthetic characteristics.

Figure 4:
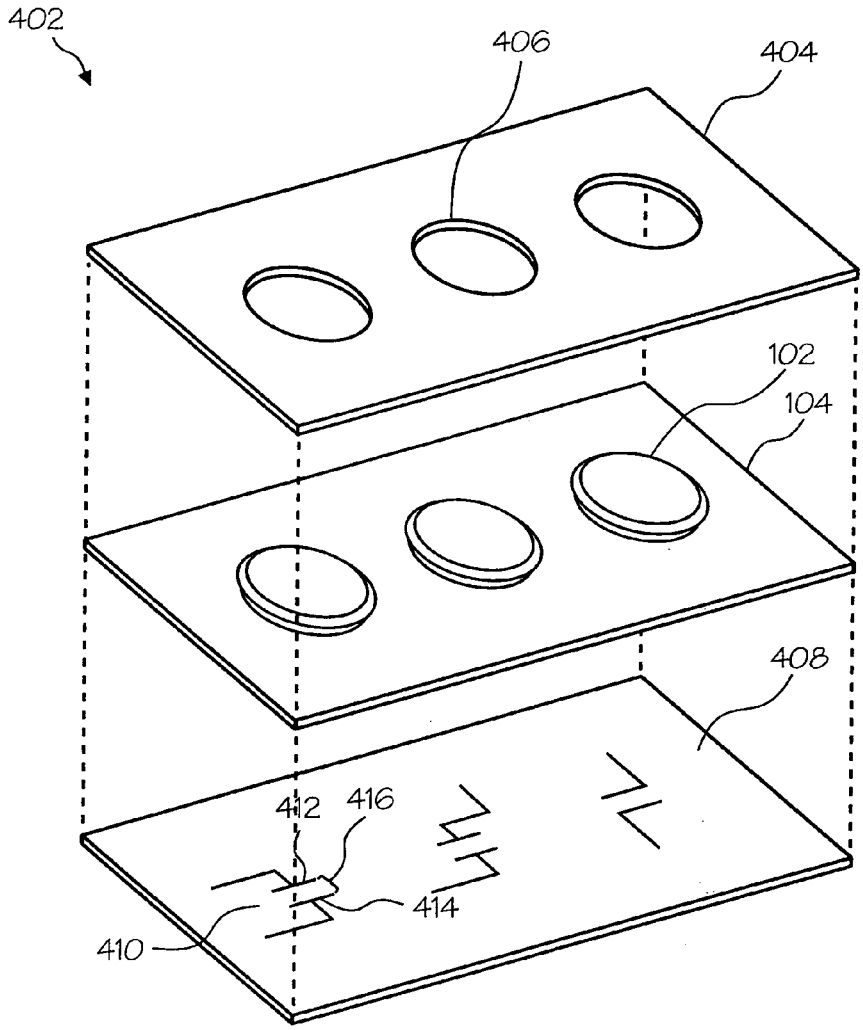
FIG. 4 is an exploded view of a switch using an elastomer keypad.

Elastomer keypad 100 can be used as an input for a switch, such a momentary switch for controlling a household appliance like a dishwasher. In one embodiment, as best seen in FIG. 4, a switch 402 includes the elastomer keypad 100, a bezel or faceplate 404 and a substrate 408 upon which the circuit for the switch is provided. Switch 402 can be any device that can receive an input (caused by the depression of one of the keys) to produce an output that can be the interpreted by the system to which it is attached. For example, switch 402 can be used as a control switch for an appliance, as a keyboard, as a remote control device, a telephone keypad and the like.

The bezel 404 holds the elastomer keys 102 of the elastomer keypad 100 in place, covers the mat 104, if provided, of the elastomer keypad 100 and provides an aesthetically pleasing surface which can then be mounted on an appliance or other device. The bezel 404 can be made of any material appropriate for the application, such as plastic, rubber, metal or even wood. Bezel 404 can be any structure having one or more openings 406 for the elastomer keys 102 of elastomer keypad 100 to pass through. For example, the bezel can be a piece of material that is fitted over the keypad and secured over the keypad when, for example, the keypad and bezel are mounted on to another structure such as a household appliance. Or, as another example, the bezel 404 can be part of a self-contained unit, such as a case, like those used for remote controls.

Figure 5:
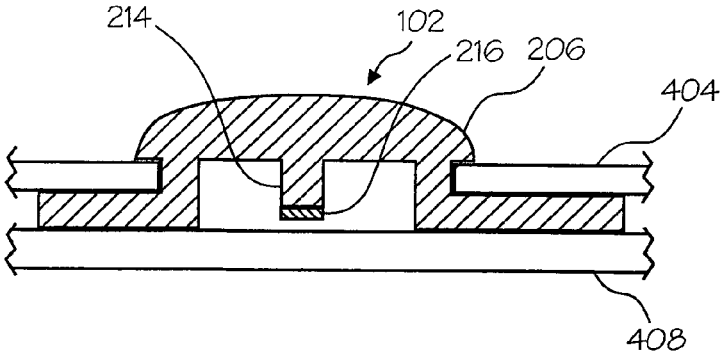
FIG. 5 is a cross sectional view of a switch using an elastomer keypad.
Figure 6:
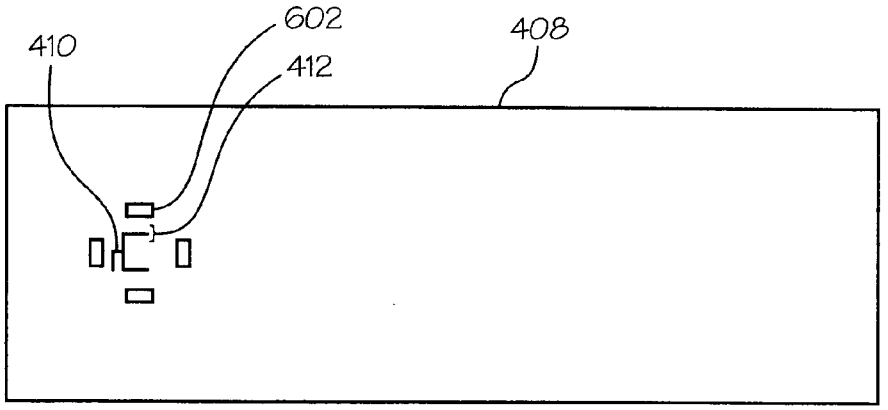
FIG. 6 is a view of a substrate for a switch with illumination sources.

The base portion 204 of each elastomer key 102 is sized to be approximately the same size, or slightly smaller than the openings 406 in the bezel 404. The cross sectional area or perimeter of the base portion 204 is approximately the same size as the cross sectional area or perimeter of the opening 406 of the bezel 404. The top portion 206 of the elastomer keys 102 is larger than the opening 406 of the bezel 404. However, since the elastomer keys 102 are made from an elastomer, they can be deformed and passed through the opening 406 of the bezel 404. After pushing through the opening 406 in the bezel 404 the top portion 206 expands back to a shape larger than the opening 406 and on the top surface 418 of the bezel 404. The top portion 206 will now preferably overlap the opening 406 and form a seal between the elastomer key 102 and the faceplate 404. This helps to prevent debris and moisture from moving between the elastomer key 102 and the top surface 418 of the bezel 404. This is best seen in FIG. 5, which is a cross sectional view of switch 402. Here the top portion 206 is disposed above the bezel 404 and overlaps the opening 406. The opening 406 of bezel 404 occupies the undercut region 212 of key 102. Not only does this arrangement prevent debris and moisture from infiltrating the switch 402, the overlapping top portion 206 hides the opening 406 of the bezel 404. This provides an enhanced atheistic appearance over other elastomer keypad arrangements.

As seen in FIG. 4, switch 402 preferably includes a substrate 408. In one embodiment substrate 408 is a printed circuit (PC) board, although the substrate 408 can be any surface upon which electronic components can be mounted and electrical trace lines can be formed. For example, substrate 408 can be made of a flexible material or a rigid material. On the substrate 408 as seen in FIG. 4, one or more switch circuits 410 are formed. Each switch circuit 410 typically includes a first conductive trace 412 and a second conductive trace 414 separated by a space 416.

Referring back to FIG. 5, elastomer key 102 includes a conductive surface 216 connected to the inside 215 of elastomer key 102, preferably, by stem 214. Each conductive surface 216 of each elastomer key 102 is positioned above one of the switch circuits 410. When the elastomer key 102 is depressed the conductive surface 216 will touch both the first conductive trace 412 and the second conductive trace 414, electrically connecting the first conductive trace 412 and the second conductive trace 414, and completing the circuit.

While the above discussed the use of the conductive surface 216 to complete the circuit, other methods of making contact with the switch circuit 410 of the substrate 408 can be used. One method is to provide a flexible strip of metal on the inside of top portion 206 such that when the top portion 206 is depressed the metal will contact the first conductive trace 412 and the second conductive trace 414 of the substrate 408. Alternatively, a metal dome can be affixed over the switch circuit 410 and the elastomer key 102 placed above it. When the elastomer key 102 is depressed the dome will be depressed inwards to the switch circuit 410 to complete the circuit. One advantage of this embodiment is that when the elastomer key 102 is depressed and released an audible noise as well as tactile sensation is produced as the metal deforms to contact the substrate 408 and then returns back to its original shape.

Additionally, the elastomer key 102 can be used to cover a mechanical switch such as a mechanical push button switch. Depressing the top portion 206 of the elastomer key 102 will depress the plunger of the switch. One advantage of this design is that it provides protection for a mechanical switch from dirt and moisture.

One potential draw back of elastomer keys 102, especially an elastomer key 102 used as a momentary switch, over a mechanical switch such as a throw switch, is that since the elastomer key 102 returns to its original shape after being pressed down it is typically impossible to tell if the elastomer key was selected based on a visual observation of the elastomer key.

To alleviate this problem, in one embodiment of the present invention, a visual indication is provided to designate the status of elastomer key 102. To provide a visual indication in one embodiment, at least a portion of the elastomer key 102 is made translucent or transparent. In one embodiment, the sidewall 210 of the top portion 206 of elastomer key 102 is translucent. The elastomer key 102 is illuminated from underneath the elastomer key 102 by one or more illumination sources 602 placed near switch circuit 410. When the top portion 206 of elastomer key 102 is depressed, the circuit is closed and the machine being controlled changes from one state to another (for example from off to on). When this occurs, the illumination source 602 also changes from one state to another (off to on). The light from the illumination source 602 will be visible through the translucent portions of the top portion 206 of elastomer key 102. If the sidewall 210 of the elastomer key 102 is translucent, the elastomer key 102 will illuminate with a "halo" effect around the sidewall 210. In one embodiment illumination source 602 is a light emitting diode (LED), such as the P/N HSM-C170 by Agilent Technologies of Santa Clara, Calif., although any source of light that is compact enough to mount under the elastomer key 102 and that will provide sufficient illumination can be used. Colored LEDs can be used to provide an enhanced indication of a machine status, such as using a green LED for indicating the on status of an on/off switch. Multiple colors may be used for each key 102 if the switch has more than a two state function.

The number and arrangement of illumination sources 602 depends on the brightness of the illumination sources 602 and the materials through which key 102 is constricted. In one embodiment, four LEDs are equally spaced around the switch circuit 410. This arrangement imparts a glowing halo around the translucent sidewall 210 of elastomer key 102.

In one embodiment, the illumination of elastomer key 102 can be enhanced. For example, the top surface 208 of the top portion 206 of the elastomer key 102 may have black indicia 106 applied over a white or translucent background. When the LEDs are on, the translucent areas around the indicia 106 will illuminate. Alternatively, the background can be formed in a dark color (black) and the indicia 106 formed from areas left white or translucent or from black that has been etched away. In this embodiment the indicia 106 will illuminate when the LEDs are on. In one embodiment the top surface 208 of the top portion 206 is covered with white ink using a silk-screen process. Then black ink is silk-screened over the white. The indicia 106 on the elastomer keys 102 can then be etched off by a laser or chemical means. The white color reflects and enhances the brightness of the light that is emitted out the sidewall 210 of the top portion 206 of the elastomer key 102.

The elastomer keypad 100 can be also used in conjunction with a display, such as a segmented LED display. For example, the elastomer keypad 100 may be used for control buttons on a dishwasher. In conjunction with the control buttons, a digital display may be provided as a countdown timer or other function. In order to provide a pleasing look and effective control surface, the digital display should be flush with the surface of the control panel (e.g., flush with top surface of bezel 404). However, if the display is mounted on the same side of the substrate 408 as the switch circuits 410 for the elastomer keys 102, the thickness of a conventional display mounted on the substrate 408 will require the elastomer keypad 100 to be mounted further from the associated switch circuits 410. This will result in a greater distance between the conductive surface 216 of the elastomer keys 102 and the switch circuit 410, which results in a greater travel for the elastomer keys 102.

Figure 7:
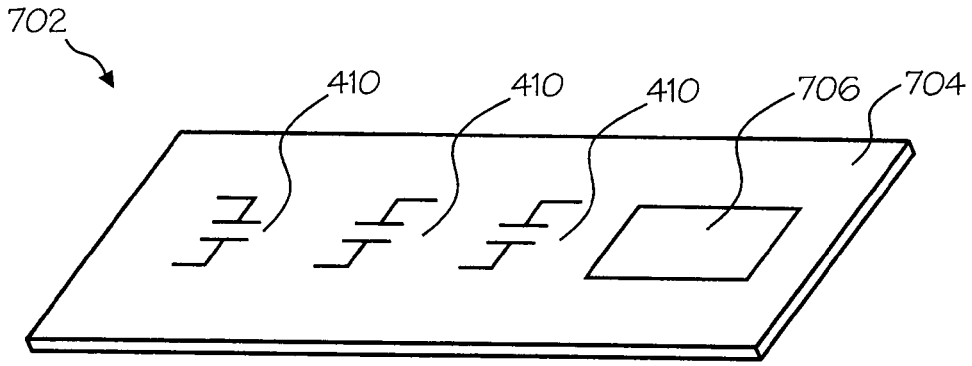
FIG. 7 is a view of a substrate for a switch having an opening for a display.
Figure 8:
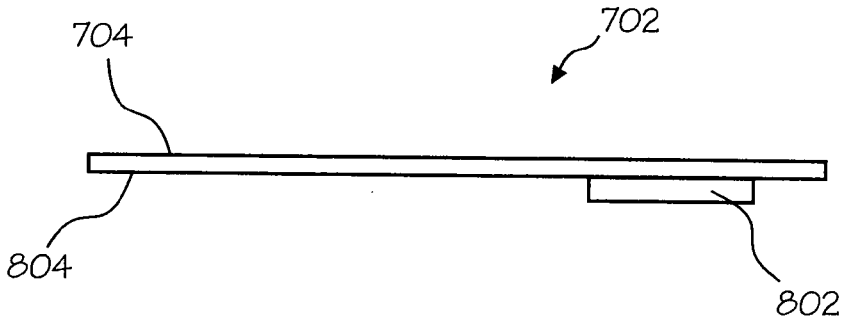
FIG. 8 is a side view of FIG. 7.

To alleviate this, and as illustrated in FIGS. 7–8, a novel way to mount a display on a printed circuit board 702 is provided. As seen in FIG. 7, a printed circuit board 702 includes switch circuits 410 mounted on a top surface 704 and a display opening 706. In order to provide a lower profile on the top surface 704 of printed circuit board 702, instead of mounting a display 802 on the top surface 704, the display 802 is mounted on the bottom side 804 of the printed circuit board 702 as seen in FIG. 8 or within the thickness of board 702. The display 802 can be any display capable of being mounted on a printed circuit board including a segmented LED display or a LCD display. Display 802 is typically soldered to the bottom side 804 of the printed circuit board 702 such that the display is visible through display opening 706.

Figure 9:
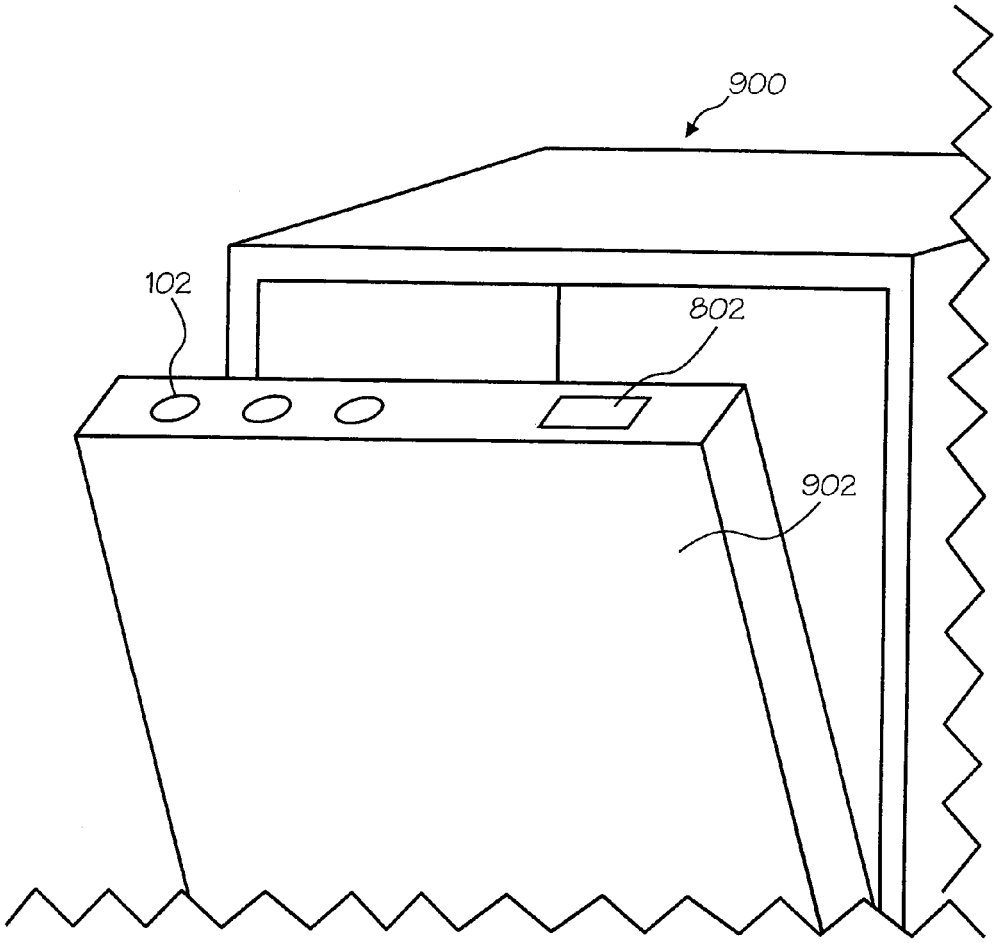
FIG. 9 illustrates a switch of the present invention mounted on a door of a dishwasher.

In one embodiment of the invention, the switch 402 can be used to control a household appliance. As illustrated in FIG. 9 the switch 402 is mounted on to a door 902 of a dishwasher 900. The elastomer keys 102 can be used to set options such as turning on a rinse cycle, turning on an energy saving mode and the like. As seen in FIG. 9, the switch also includes the display 802. Because the display 802 is mounted on the bottom of, or partially embedded within, the circuit board (not visible in FIG. 9 but discussed in conjunction with FIGS. 7 and 8), the display 802 is flush (or nearly flush) on the surface of the door 902. By providing elastomer keys 102 in accordance with the teachings of the present invention, elements found in the kitchen, such as a moisture or food particles, cannot penetrate pass the top portion 206 of the elastomer key 102. Also, the elastomer keys 102 appear to be integral with the bezel, enhancing the appearance of the dishwasher.

Although there have been described preferred embodiments of this novel invention, many variations and modifications are possible and the embodiments described herein are not limited by the specific disclosure above, but rather should be limited only by the scope of the appended claims.

What is claimed is:

1. A flexible key for use in a keypad comprising:

a top section having a first cross sectional area;

a mat; and a base section connected to the top section and the mat, the base section having a second cross sectional area, the second cross sectional area smaller than the first cross sectional area and uniform between the top section and the mat.

2. The key of claim 1 wherein the key is mounted through an opening of a bezel such that the top section of the key is on a top surface of the bezel, and wherein the cross sectional area of the bezel is smaller than the first cross sectional area.

3. The key of claim 1 further comprising a conductive surface formed on an underneath side of the key.

4. The key of claim 3 wherein the key is mounted over a switch circuit on a substrate such that the conductive surface is over the switch circuit.

5. The key of claim 4, wherein the substrate is a printed circuit board.

6. The key of claim 5 wherein the printed circuit board has an opening and a display is mounted on a bottom side of the printed circuit board such that the display is visible through the opening.

7. The key of claim 3 wherein the conductive surface is carbon.

8. The key of claim 1 wherein at least a part of the key is translucent to allow illumination from a light source located beneath the key to be visible.

9. The key of claim 8 wherein the light source is one or more light emitting diodes mounted beneath the key.

10. A keypad and bezel assembly comprising:

a keypad comprising at least one key mounted on a mat, each of the at least one key comprising:

a top section having a first perimeter;

a base portion having a second perimeter, the second perimeter smaller than the first perimeter; and a bezel mountable over the keypad, the bezel having one or more openings, corresponding to the one or more keys and wherein the top section of each of the one or more keys is mounted through the each of the one or more openings such that the top section of each of the one or more keys is on the top surface of the bezel and overlaps part of the bezel.

11. The keypad and bezel assembly of claim 10 further comprising a conductive surface formed on an underneath side each of the at least one key.

12. The keypad and bezel assembly of claim 10 wherein each of the at least one key is mounted over a switch circuit on a substrate such that the conductive surface is over the switch circuit.

13. The keypad and bezel assembly of claim 10 wherein the substrate is a printed circuit board.

14. The keypad and bezel assembly of claim 13 wherein the printed circuit board has an opening and a display is mounted on a bottom side of the printed circuit board such that the display is visible through the opening.

15. The keypad and bezel assembly of claim 10 wherein at least a part of one or more of the at least one key is translucent to allow illumination from a light source located beneath the key to be visible.

16. The keypad and bezel assembly of claim 15 wherein the light source is one or more light emitting diodes mounted beneath the key.

17. A switch comprising:

one or more keys mounted on a mat, each of the one or more keys having a top section, a bottom section and an undercut region formed between the top section, the bottom section and the mat, and each of the one more keys having a conductive surface mounted on an underside; and a substrate having one or more switch circuits corresponding to each of the one or more keys, each of the one or more keys mounted over each of the switch circuits and wherein when each of the keys is depressed the conductive surface contacts the switch circuit, completing the circuit.

18. The switch of claim 17 wherein the conductive surface is carbon.

19. The switch of claim 17 wherein the substrate is a rigid printed circuit board.

20. The switch of claim 19 wherein the printed circuit board has an opening and a display is mounted on a bottom side of the printed circuit board such that the display is visible through the opening.

21. The switch of claim 17 wherein the substrate is a flexible circuit board.

22. The switch of claim 17 further comprising a bezel having one or more openings corresponding to the one or more keys, each of the one or more keys mounted through the one or more openings such that the top section of each of the one or more keys is on a top surface of the bezel and the bezel is in the undercut region.

23. The switch of claim 22 wherein the bezel is part of a case.

24. The switch of claim 17 wherein the at least part of at least one of the one or more keys is translucent to allow illumination from a light source to be visible.

25. The switch of claim 24 wherein the light source is a light emitting diode.

26. The switch of claim 17 wherein the key is made of silicon rubber.

27. The switch of claim 17 wherein the switch controls a household appliance.

28. A switch comprising:

one or more keys mounted on a mat, each of the one or more keys having a top section, a bottom section and an undercut region formed between the top section, the bottom section and the mat, and each of the one more keys having a conductive surface mounted on an underside;

a substrate having one or more switch circuits corresponding to each of the one or more keys, each of the one or more keys mounted over each of the switch circuits and wherein when each of the keys is depressed the conductive surface contacts the switch circuit, completing the circuit; and a bezel having one or more openings corresponding to the one or more keys, each of the one or more keys mounted through the one or more openings such that the top section of each of the one or more keys is on a top surface of the bezel and the bezel is in the undercut region.

29. The switch of claim 28 wherein the conductive surface is carbon.

30. The switch of claim 28 wherein the substrate is a rigid printed circuit board.

31. The switch of claim 30 wherein the printed circuit board has an opening and a display is mounted on a bottom side of the printed circuit board such that the display is visible through the opening.

32. The switch of claim 28 wherein the substrate is a flexible circuit board.

33. The switch of claim 28 wherein the bezel is part of a case.

34. The switch of claim 28 wherein the at least part of at least one of the one or more keys is translucent to allow illumination from a light source to be visible.

35. The switch of claim 34 wherein the light source is a light emitting diode.

36. The switch of claim 28 wherein the key is made of silicon rubber.

37. The switch of claim 28 wherein the switch controls a household appliance.

38. The switch of claim 37, wherein the household appliance is a dishwasher.

* * * * *